US008094177B2

(12) United States Patent
Murayama

(10) Patent No.: US 8,094,177 B2
(45) Date of Patent: Jan. 10, 2012

(54) MODIFYING ROTATION SPEED WITHIN AN IMAGE-FORMING DEVICE

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 33 days.

(21) Appl. No.: 12/641,800

(22) Filed: Dec. 18, 2009

(65) Prior Publication Data

US 2010/0189451 A1 Jul. 29, 2010

(30) Foreign Application Priority Data

Jan. 28, 2009 (JP) ..... 2009-016727

(51) Int. Cl.
*B41J 2/435* (2006.01)
*B41J 2/47* (2006.01)

(52) U.S. Cl. ..... 347/235; 347/250

(58) Field of Classification Search ..... 347/229, 347/231, 248–250, 259–261, 116, 234, 235
See application file for complete search history.

(56) References Cited

U.S. PATENT DOCUMENTS

| | | | | |
|---|---|---|---|---|
| 6,104,420 | A | 8/2000 | Matsumoto | |
| 6,853,816 | B2 * | 2/2005 | Miyata | 399/46 |
| 7,417,652 | B2 * | 8/2008 | Yamazaki | 347/116 |
| 2007/0126851 | A1 | 6/2007 | Yamazaki | |

FOREIGN PATENT DOCUMENTS

| | | |
|---|---|---|
| JP | 08-146827 | 6/1996 |
| JP | 10-020736 | 1/1998 |
| JP | 10-151801 A | 6/1998 |
| JP | 11-237576 A | 8/1999 |
| JP | 2003-098915 A | 4/2003 |
| JP | 2006-198999 | 8/2006 |
| JP | 2007-045074 | 2/2007 |
| JP | 2007-179005 | 7/2007 |

OTHER PUBLICATIONS

Japanese Office Action mailed Mar. 8, 2011 in Japanese Application No. 2009-016727 and English translation thereof.

* cited by examiner

*Primary Examiner* — Hai C Pham
(74) *Attorney, Agent, or Firm* — Banner & Witcoff, Ltd.

(57) ABSTRACT

In an image-forming device includes an image-forming unit, a first conveying unit, a first changing unit, and a second changing unit. The image-forming unit includes a rotatable mirror, a light-emitting unit, a photosensitive drum, a developing unit, a transferring unit. An electrostatic latent image composed of a plurality of line electrostatic latent images extending in a main scanning direction over a first length is formed on the photosensitive drum. The first conveying unit conveys a recording medium to the transferring position in a sub-scanning direction orthogonal to the main scanning direction. The first changing unit changes a rotating speed of the rotatable mirror to change the first length. The second changing unit proportionally changes a conveying speed of the first conveying unit in accordance with the change of the rotating speed of the rotatable mirror.

4 Claims, 8 Drawing Sheets

MODIFYING ROTATION SPEED WITHIN AN IMAGE-FORMING DEVICE

CROSS REFERENCE TO RELATED APPLICATION

This application claims priority from Japanese Patent Application No. 2009-016727 filed Jan. 28, 2009.The entire content of this application is incorporated herein by reference.

TECHNICAL FIELD

The present invention relates to an image-forming device, and particularly to an image-forming device that employs light reflected off a rotating mirror as a means of exposure.

BACKGROUND

Electrophotographic image-forming devices well known in the art form images on paper by first forming electrostatic latent images on photosensitive drums with laser beams reflected off a rotating polygon mirror and scanned in cycles over the photosensitive drums and by subsequently developing the electrostatic latent images with toner and transferring and fixing these toner images to the paper. A technology has been proposed for finely adjusting the magnification of the formed image in the main scanning direction in this type of image-forming device by controlling the rotating speed of the polygon mirror during the scanning process.

SUMMARY

However, changes in the rotating speed of the polygon mirror also modify the length of the scanning cycle, which in turn changes the scanning interval on the photosensitive drum relative to the sub-scanning direction, as well as the virtual scanning interval on the sheet of paper. Hence, changing the speed of the polygon mirror may result in deviations in image-forming positions and density irregularities that will degrade image quality.

In view of the foregoing, it is an object of the present invention to provide an image-forming device capable of avoiding a loss in image quality caused by adjusting the rotating speed of the polygon mirror.

In order to attain the above and other objects, the invention provides an image-forming device including an image-forming unit, a first conveying unit, a first changing unit, and a second changing unit. The image-forming unit includes a rotatable mirror, a light-emitting unit, a photosensitive drum, a developing unit, a transferring unit. The light-emitting unit repeatedly emits a laser beam to the rotatable mirror. Each laser beam is emitted over a predetermined period and reflected by the rotatable mirror. The photosensitive drum rotates at a predetermined rotating speed to be subject to a scanning with each reflected laser beam. The scanning forms an electrostatic latent image composed of a plurality of line electrostatic latent images extending in a main scanning direction over a first length. Neighboring line electrostatic latent images are spaced by a second length. The developing unit develops the electrostatic latent image with a developer to form a developer image. The transferring unit transfers the developer image formed on the photosensitive drum to a recording medium at a transferring position to form an image. The first conveying unit conveys the recording medium to the transferring position in a sub-scanning direction orthogonal to the main scanning direction. The first changing unit changes a rotating speed of the rotatable mirror to change the first length. The second changing unit proportionally changes a conveying speed of the first conveying unit in accordance with the change of the rotating speed of the rotatable mirror.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, a preferred embodiment of the present invention will be described with reference to FIGS. 1 through 8.

<Overall Structure of a Printer>

Figure 1:
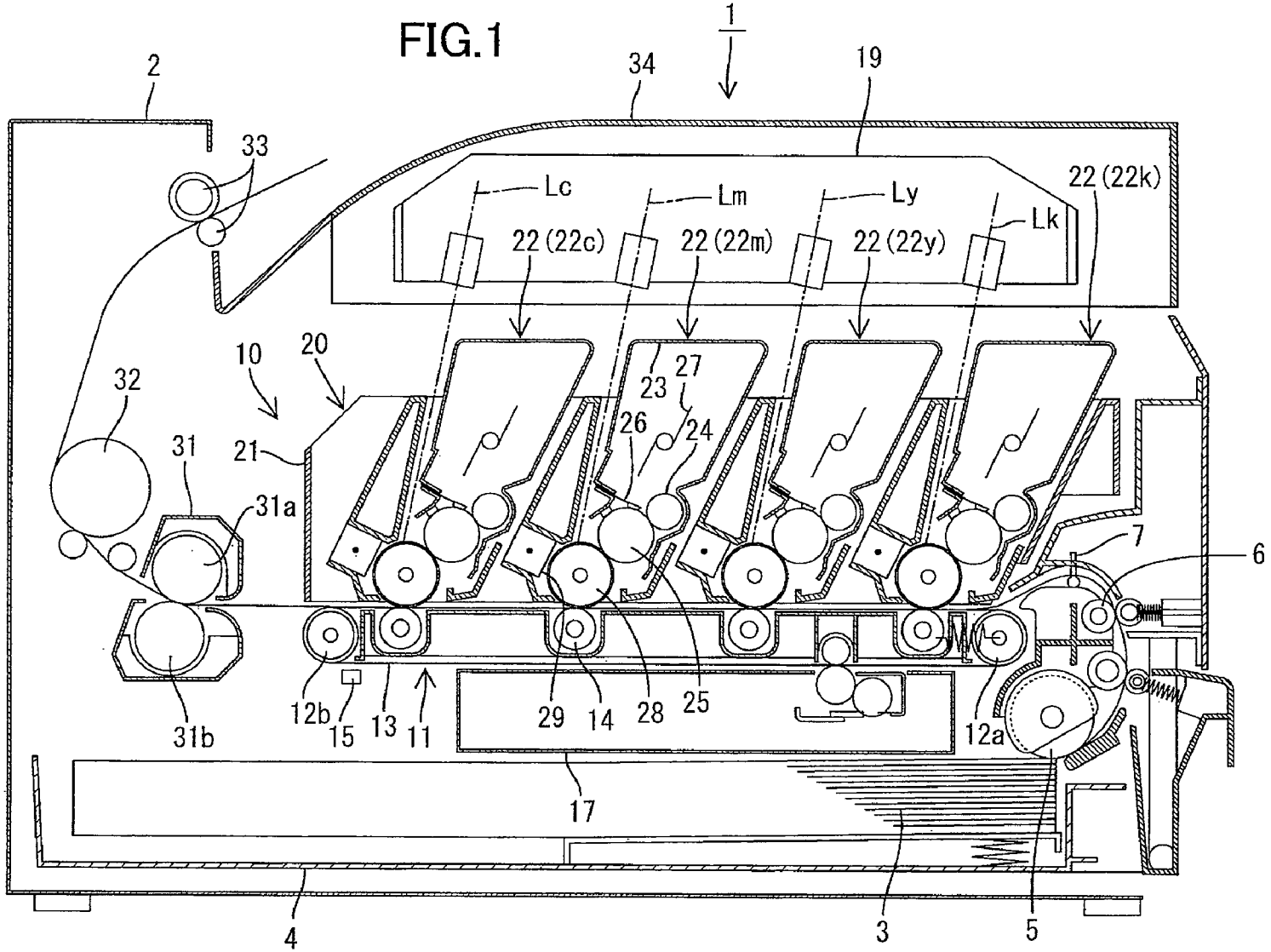
FIG. 1 is a cross-sectional view showing an overall structure of a printer 1 according to a preferred embodiment of the present invention.

FIG. 1 is a cross-sectional view showing the overall structure of a printer 1 according to the preferred embodiment of the present invention. The printer 1 according to the preferred embodiment is a direct transfer tandem type color laser printer that forms images using the four colors black, yellow, magenta, and cyan. In the following description, the right side of the printer 1 will be referred to as the front side. Further, for convenience, reference numerals for components that are shared among the four colors are given for only one color and omitted for the other colors in FIG. 1.

The printer 1 includes a main casing 2, and a paper tray 4 disposed in the bottom section of the main casing 2 for accommodating overlaid sheets of a paper 3. A feeding roller 5 conveys sheets of the paper 3 from the paper tray 4 toward registration rollers 6 positioned downstream. The registration rollers 6 convey the paper 3 onto a belt unit 11 provided in an image-forming unit 10 described later. A registration sensor 7 is disposed between the registration rollers 6 and the belt unit 11 for detecting the presence of the paper 3. As will be described later, the timing at which an image is written to the paper 3 is based on the timing at which the registration sensor 7 detects the leading edge of the sheet.

The image-forming unit 10 includes the belt unit 11, a scanning unit 19, a process unit 20, and a fixing unit 31.

The belt unit 11 includes a belt support roller 12*a* and a belt drive roller 12*b* disposed apart from each other in the front-to-rear direction, and a circular belt 13 formed of polycarbonate or the like that is mounted around the rollers 12*a* and 12*b*. When the rearwardly disposed belt drive roller 12*b* is driven to rotate, the belt 13 moves circularly in the counterclockwise direction of FIG. 1 so as to convey a sheet of paper 3 electrostatically attracted to the top surface of the belt 13 rearward. Four transfer rollers 14 are disposed inside the belt 13 at positions opposing respective photosensitive drums 28 of the process unit 20 described later through the belt 13.

A pair of left and right pattern sensors 15 is disposed beneath the belt 13 for detecting patterns formed on the belt 13. The sensors 15 irradiate light onto the surface of the belt 13 and receive the reflected light with a phototransistor or the like. The sensors 15 output signals of a level corresponding to the intensity of received light. A cleaner 17 is disposed beneath the belt unit 11 for recovering toner, paper dust, and the like from the surface of the belt 13.

The scanning unit 19 irradiates laser beams Lk, Ly, Lm, and Lc onto the surfaces of the respective photosensitive drums 28 based on image data for the corresponding colors. The structure of the scanning unit 19 will be described later in greater detail.

The process unit 20 includes a frame 21, and four developer cartridges 22 (22*k*, 22*y*, 22*m*, and 22*c*) corresponding to the four colors (black, yellow, magenta, and cyan) that are juxtaposed in the front-to-rear direction and detachably held in the frame 21. In the bottom of the frame 21 at positions corresponding to each of the developer cartridges 22 are provided photosensitive drums 28 whose surfaces are covered with a positive charging photosensitive layer, and Scorotron chargers 29.

Each of the developer cartridges 22 includes a toner-accommodating section 23 for accommodating toner and, disposed in the bottom region of the toner-accommodating section 23, a supply roller 24, a developing roller 25, a thickness-regulating blade 26, and an agitator 27. The supply roller 24 supplies toner discharged from the toner-accommodating section 23 onto the developing roller 25, at which time the toner is positively tribocharged between the rollers 24 and 25. The thickness-regulating blade 26 functions both to regulate the thickness of toner carried on the developing roller 25 and to further tribocharge the toner.

The chargers 29 applies a positive charge to the surface of the photosensitive drum 28, and the scanning unit 19 subsequently exposes portions of the positively charged surface with a scanned laser beam to form an electrostatic latent image thereon. The electrostatic latent image is subsequently developed into a toner image (developed image) by toner supplied from the developing roller 25.

The toner images carried on the photosensitive drums 28 are sequentially transferred onto a sheet of paper 3 by a transfer voltage of negative polarity applied to the transfer rollers 14 as the sheet passes through transfer positions between each photosensitive drum 28 and the corresponding transfer roller 14. After the toner images have been transferred onto the paper 3, the paper 3 is conveyed to the fixing unit 31.

The fixing unit 31 includes a heating roller 31*a* having a heat source, and a pressure roller 31*b* that serves to press the paper 3 against the heating roller 31*a*. The fixing unit 31 fixes the toner images transferred onto the paper 3 to the surface of the paper with heat. After passing through the fixing unit 31, the paper 3 is conveyed upward by a conveying roller 32 and is discharged by discharge rollers 33 onto a discharge tray 34 provided on the top surface of the conveying roller 32.

<Electrical Structure of the Printer>

Figure 2:
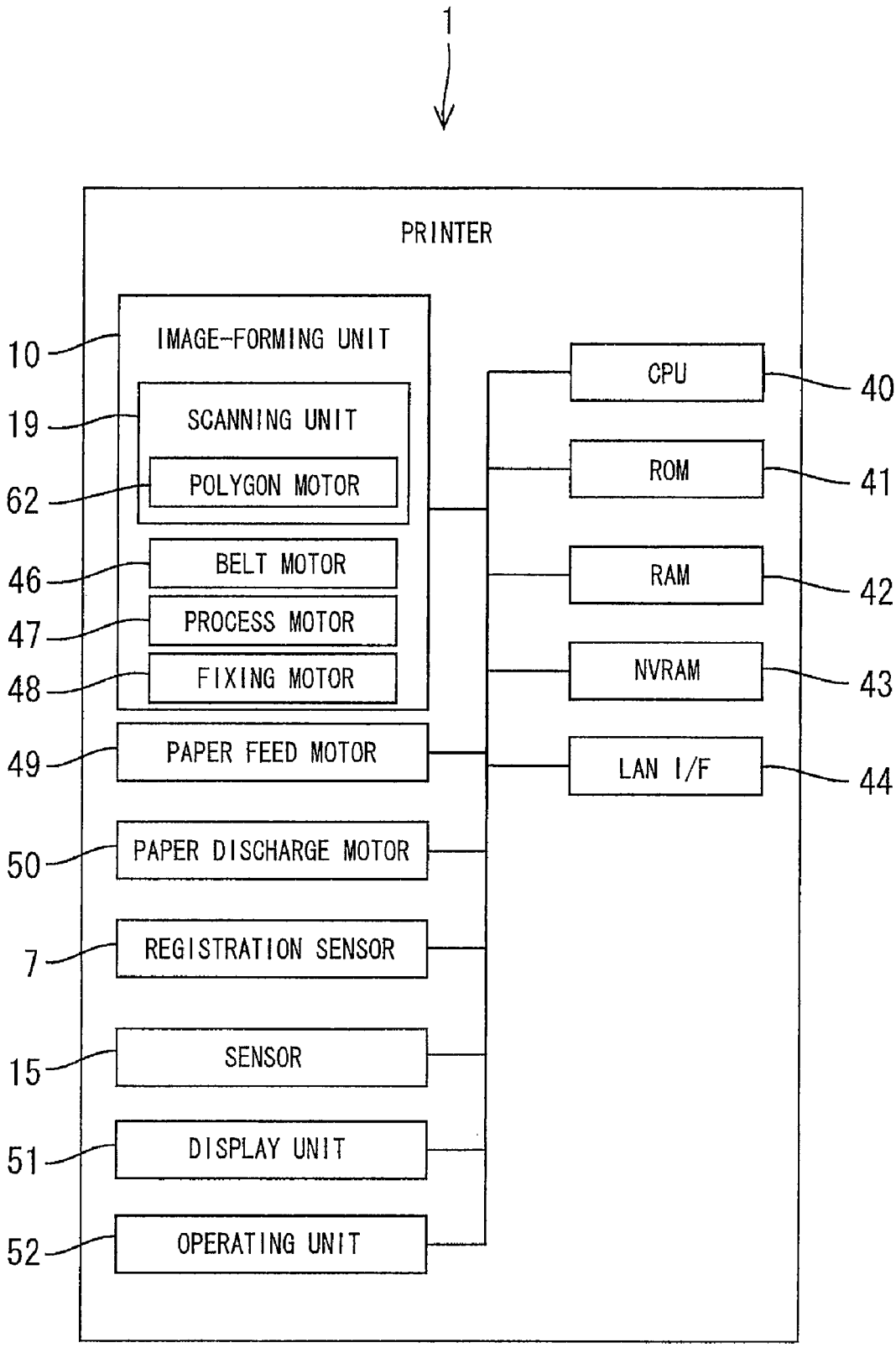
FIG. 2 is a block diagram showing a simplified electrical structure of the printer 1.

FIG. 2 is a block diagram showing a simplified electrical structure of the printer 1. As shown in FIG. 2, the printer 1 includes a CPU 40, a ROM 41, a RAM 42, a NVRAM (non-volatile memory) 43, and a network interface 44, which are all connected to the image-forming unit 10, registration sensor 7, and sensors 15 described earlier, as well as a paper feed motor 49, a paper discharge motor 50, a display unit 51, an operating unit 52, and the like.

The ROM 41 stores programs for implementing various operations on the printer 1, including a main scan magnification adjustment process described later. The CPU 40 controls each component of the printer 1 through processes performed according to the programs read from the ROM 41, while storing results of processes in the RAM 42 or NVRAM 43. The network interface 44 is connected to an external computer (not shown) or the like via a communication network for enabling data communications between the two devices.

The scanning unit 19 of the image-forming unit 10 includes a polygon mirror 61 described later, and a polygon motor 62 for rotating the polygon mirror 61. The image-forming unit 10 is also provided with a belt motor 46 for driving the belt drive roller 12*b*, a process motor 47 for driving the developing rollers 25, photosensitive drums 28, and the like, and a fixing motor 48 for driving the heating roller 31*a*. The paper feed motor 49 drives the feeding roller 5 and registration rollers 6 to rotate. The paper discharge motor 50 drives the conveying roller 32 and discharge rollers 33 to rotate. Each of the motors 46-50 is controlled based on a pulse width modulation (PWM) signal supplied by the CPU 40.

The display unit 51 includes a liquid crystal display (LCD), indicator lamps, and the like and is capable of displaying various configuration screens, the device operating status, and the like. The operating unit 52 includes a plurality of buttons for enabling a user to perform various input operations.

<Structure of the Scanning Unit>

Figure 3:
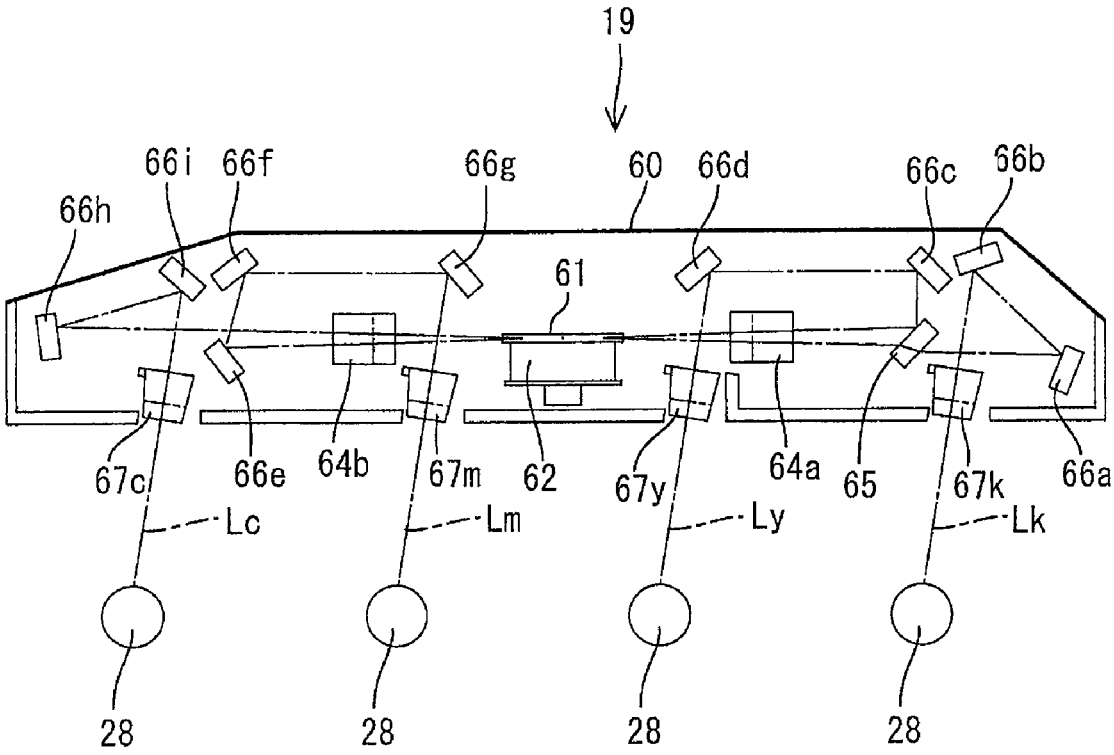
FIG. 3 is a side view of an optical system provided in a scanning unit 19.
Figure 4:
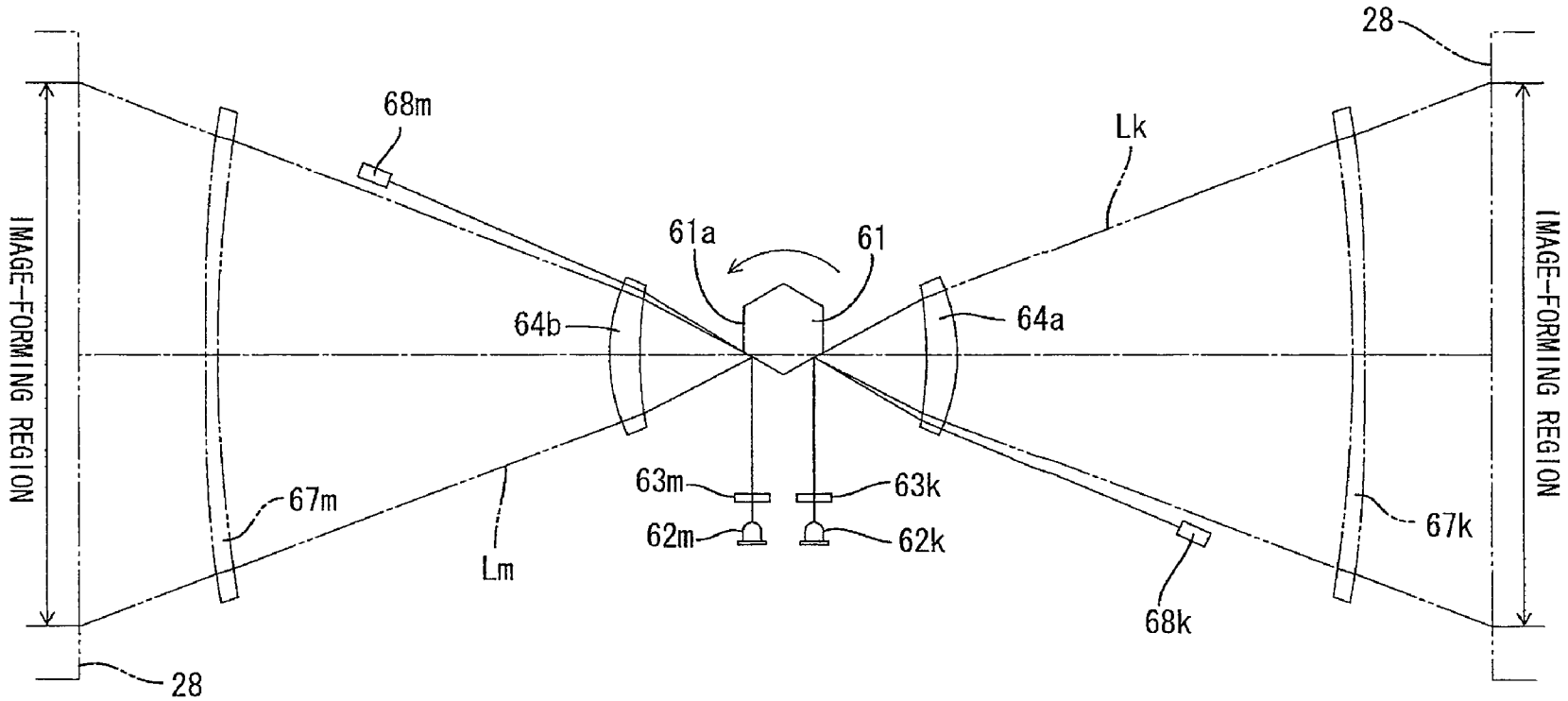
FIG. 4 is a plan view of the optical system.

FIG. 3 is a side view of an optical system provided in the scanning unit 19. FIG. 4 is a plan view of the optical system. In FIG. 4, the optical paths of the laser beams Lk corresponding to black and Lm corresponding to magenta have been abbreviated, omitting portions of the paths reflected by the reflecting mirrors.

As shown in FIG. 3, the scanning unit 19 has a box-shaped case 60. Disposed in the center of the case 60 are the polygon mirror 61 having a plurality (six in the preferred embodiment) of vertical reflecting surfaces 61*a* (see FIG. 4), and the polygon motor 62 for rotating the polygon mirror 61 in the counterclockwise direction of FIG. 4. The scanning unit 19 also includes four laser light-emitting elements 62*k*, 62*y*, 62*m*, and 62*c* corresponding to the four colors (only laser light-emitting elements 62*k* and 62*m* corresponding to black and magenta, respectively, are shown in FIG. 4). The laser light-emitting elements are configured of laser diodes.

The laser light-emitting element 62*k* emits the laser beam Lk modulated based on black image data. The laser beam Lk emitted from the laser light-emitting element 62*k* passes through a cylindrical lens 63*k* and strikes one reflecting surface 61*a* of the polygon mirror 61 in a direction obliquely downward. The laser beam Lk is reflected forward (rightward in FIG. 3) off the reflecting surface 61*a*, passes through a first scanning lens 64*a* (fθ lens or the like) and a half mirror 65, is redirected to a downward direction by reflecting mirrors 66*a* and 66*b*, passes through a second scanning lens 67*k* (tonic lens or the like), and is irradiated onto the corresponding photosensitive drum 28. The laser beam Lk is scanned line by line over the surface of the photosensitive drum 28 from left to right (bottom to top in FIG. 4) by the rotating polygon mirror 61.

Similarly, a laser light-emitting element (not shown) corresponding to yellow is disposed slightly below the black laser light-emitting element 62*k* and emits the laser beam Ly modulated based on yellow image data. The laser beam Ly passes through a cylindrical lens (not shown) and strikes one reflecting surface 61*a* of the polygon mirror 61 in a direction obliquely upward. The laser beam Ly is reflected forward, passes through the first scanning lens 64*a*, is reflected by the half mirror 65 and reflecting mirrors 66*c* and 66*d*, passes through a second scanning lens 67*y*, and is irradiated onto the corresponding photosensitive drum 28. The laser beam Ly is scanned line by line over the surface of the photosensitive drum 28 from left to right (bottom to top in FIG. 4) by the rotating polygon mirror 61.

The laser light-emitting element 62*m* emits the laser beam Lm modulated based on magenta image data. The laser beam Lm passes through a cylindrical lens 63*m* and strikes one reflecting surface 61*a* of the polygon mirror 61 in a direction obliquely downward. The laser beam Lm is reflected rearward, passes through a first scanning lens 64*b*, is redirected downward by reflecting mirrors 66*e*, 66*f*, and 66*g*, passes through a second scanning lens 67*m*, and is irradiated onto the corresponding photosensitive drum 28. The laser beam Lm is scanned line by line over the surface of the photosensitive drum 28 from right to left (top to bottom in FIG. 4) by the rotating polygon mirror 61.

A laser light-emitting element corresponding to cyan (not shown) disposed slightly below the magenta laser light-emitting element 62*m* emits the laser beam Lc modulated based on cyan image data. The laser beam Lc passes through a cylindrical lens (not shown) and strikes one reflecting surface 61*a* of the polygon mirror 61 in a direction obliquely upward. The laser beam Lc is reflected rearward, passes through the first scanning lens 64*b*, is reflected by reflecting mirrors 66*h* and 66*i*, passes through a second scanning lens 67*c*, and is irradiated onto the corresponding photosensitive drum 28. The laser beam Lc is scanned line by line over the surface of the photosensitive drum 28 from right to left (top to bottom in FIG. 4) by the rotating polygon mirror 61.

The scanning unit 19 is also provided with a pair of BD (Beam Detector) sensors 68*k* and 68*m*. The BD sensor 68*k* detects the laser beam Lk at an end position within the irradiating range of the laser beam Lk passing through the first scanning lens 64*a*, and particularly on the end that the laser beam begins writing ("writing start side"). The BD sensor 68*k* outputs a BD signal when the laser beam is detected. The BD sensor 68*m* detects the laser beam Lm on the writing start side of the irradiating range of the laser beam Lm passing through the first scanning lens 64*b* and outputs a BD signal when the laser beam is detected. The CPU 40 controls the rotating speed of the polygon mirror 61 driven by the polygon motor 62 based on these BD signals.

<Main Scan Magnification Adjustment Process>

Figure 5:
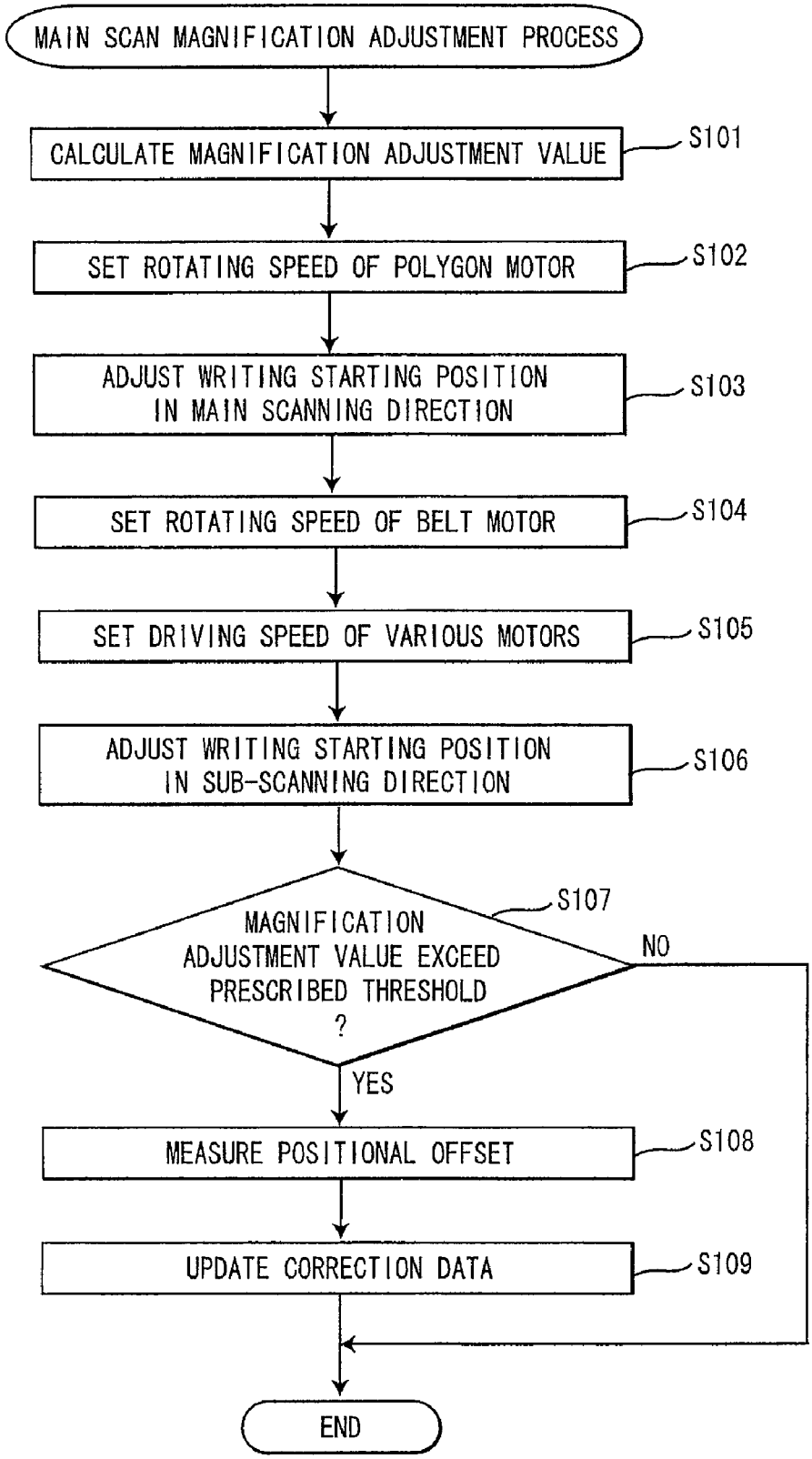
FIG. 5 is a flowchart illustrating steps in a main scan magnification adjustment process.
Figure 6:
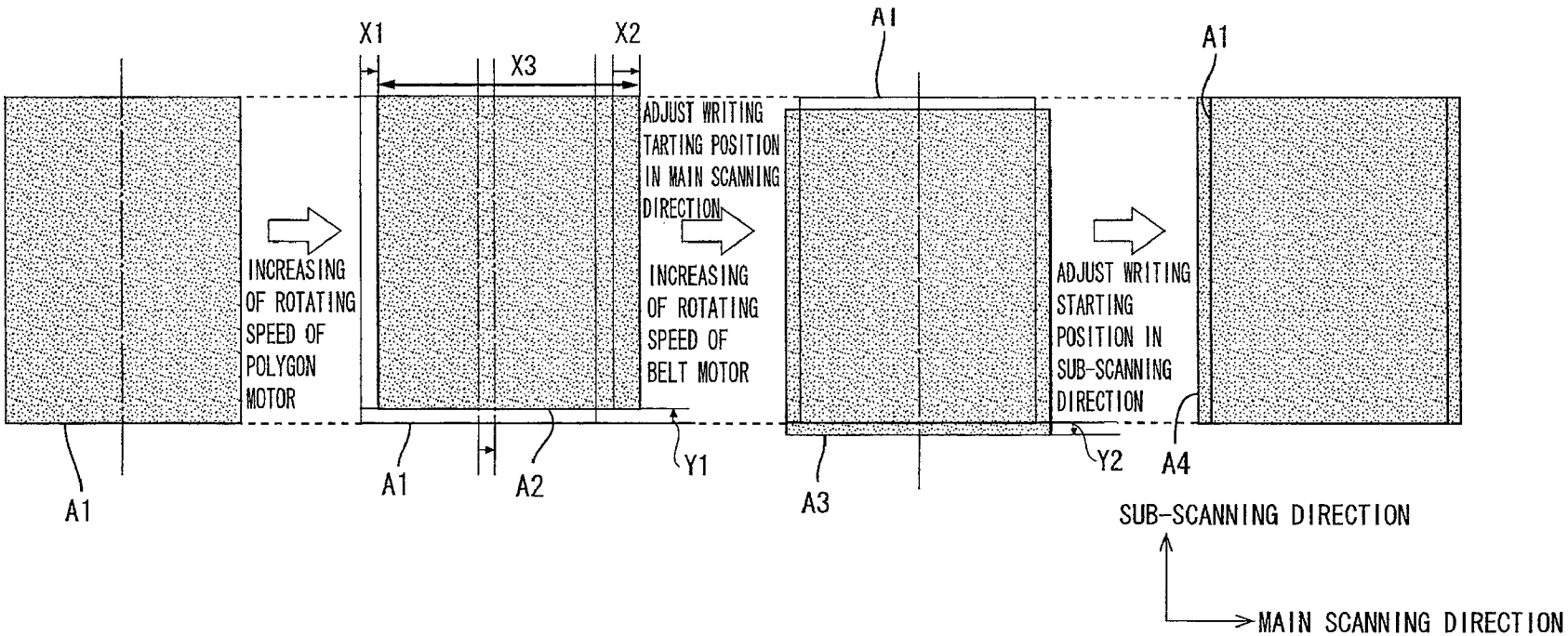
FIG. 6 is an explanatory diagram illustrating adjustments made in the main scan magnification adjustment process.
Figure 7:
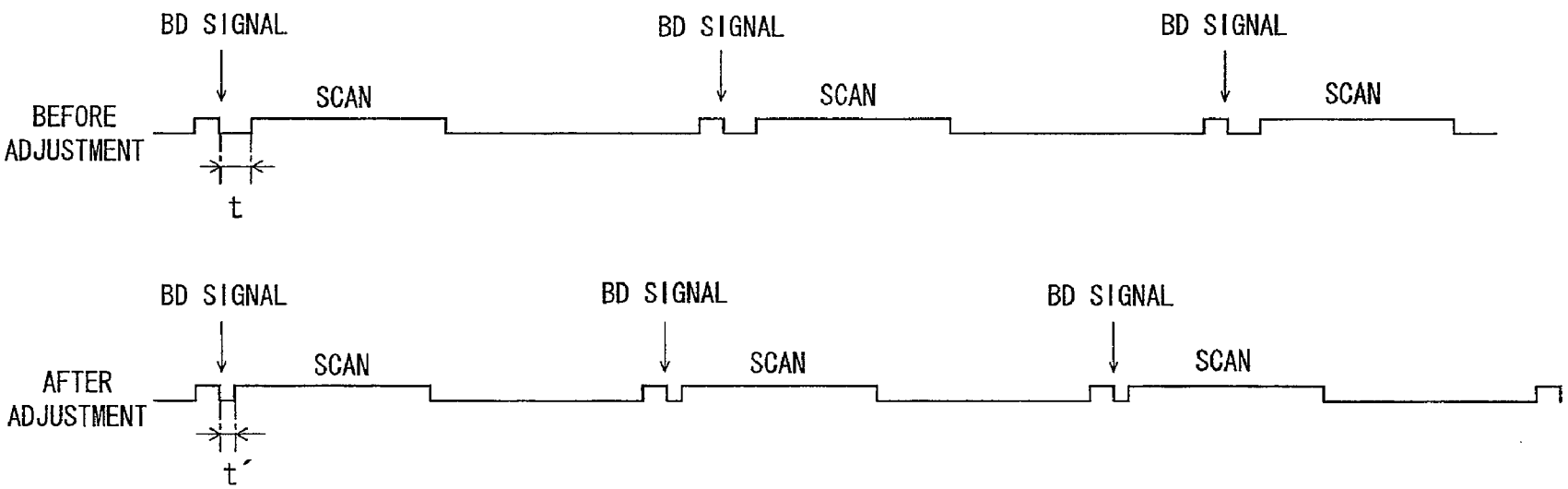
FIG. 7 is a timing chart showing an example of adjusting a timing at which a laser beam Lk is scanned.
Figure 8:
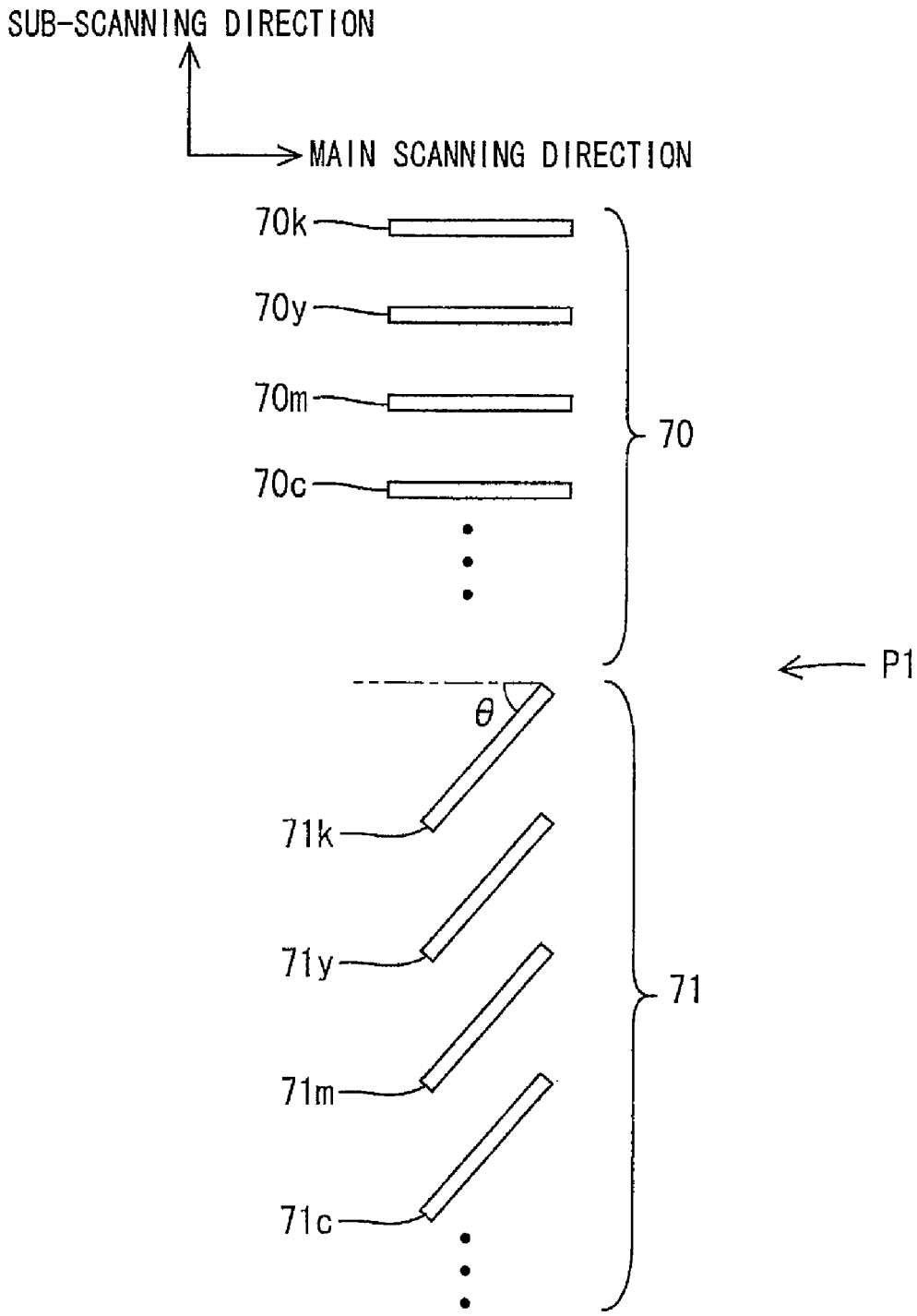
FIG. 8 shows a pattern P1 for measuring positional offset.

FIG. 5 is a flowchart illustrating steps in the main scan magnification adjustment process. FIG. 6 is an explanatory diagram illustrating adjustments made in the main scan magnification adjustment process. FIG. 7 is a timing chart showing an example of adjusting the timing at which the laser beam Lk is scanned. FIG. 8 shows a pattern P1 for measuring positional offset.

The main scan magnification adjustment process is performed to fine-tune printing magnification (the image-forming region) in the main scanning direction. The CPU 40 executes this process when the user inputs a desired size of the formed image in the main scanning direction on the operating unit 52, for example. In S101 at the beginning of the main scan magnification adjustment process of FIG. 5, the CPU 40 calculates magnification adjustment values for adjusting a print magnification in the main scanning direction for each color based on the inputted size of the formed image while referencing correction data produced in a previous positional offset measurement (described later).

FIG. 7 shows the drive timing of the laser light-emitting element 62*k* both before and after adjustments are made. As shown in FIG. 7, the laser light-emitting element 62*k* for black is driven for a fixed time period just before scanning each line. Upon detecting the laser beam Lk, the BD sensor 68*k* outputs a BD signal. The scanning unit 19 begins writing when a BD time t has elapsed after the BD signal was outputted and scans one line in a prescribed time. The laser light-emitting element 62*m* for magenta is similarly driven based on the timing at which the BD sensor 68*m* outputs a BD signal. The laser light-emitting element 62*y* for yellow is driven to scan at the same timing as black, while the laser light-emitting element 62*c* for cyan is driven to scan at the same timing as magenta. The BD time t is set for each color based on the correction data obtained in the positional offset measurement.

In S101, in S102 the CPU 40 sets the rotating speed of the polygon motor 62 based on this magnification adjustment value calculated in S101. More specifically, the CPU 40 finds a rotating speed of the polygon motor 62 (polygon mirror 61) based on the print magnification adjustment value and stores a setting (PWM value or the like) for rotating the polygon motor 62 at this speed in the NVRAM 43. In the subsequent printing operation, the CPU 40 controls the polygon motor 62 to rotate at a speed based on the setting stored in the NVRAM 43.

When adjusting the print magnification to a 0.1 percent increase, for example, the CPU 40 stores a setting for increasing the rotating speed of the polygon motor 62 by 0.1 percent (while referencing the offset measured in the previous positional offset measurement). Since the scanning time per line is constant, the size of the formed image in the main scanning direction is increased by 0.1 percent when increasing the rotating speed of the polygon mirror 61 by 0.1 percent. Conversely, when decreasing the print magnification, the CPU 40 stores a setting that reduces the rotating speed of the polygon motor 62.

FIG. 6 shows steps of the adjustment process for one color (black, for example) in the main scan magnification adjustment process, where A1 indicates the image-forming region being adjusted. As described above, the scanning time per line is constant. Therefore, if the rotating speed of the polygon motor 62 is increased, it is possible to expand the size of the formed image in the main scanning direction, as indicated by A2 in FIG. 6. However, if the BD time t is unchanged, the writing starting positions in the main scanning direction for black and yellow images are shifted rightward, as indicated by A2 (X1) in FIG. 6, while the writing starting positions in the main scanning direction for magenta and cyan images are shifted leftward (not shown). The writing ending positions in the main scanning directions for black and yellow images are also shifted rightward, as indicated by A2 (X2) in FIG. 6 while the writing ending positions in the main scanning direction for magenta and cyan images are also shifted leftward (not shown). Therefore, in S103 the CPU 40 adjusts the writing starting position in the main scanning direction by modifying the BD time t to a BD time t', as shown in FIG. 7, so that the center position of the image-forming region A2 in the main scanning direction is aligned with the center position of the image-forming region A1 in the main scanning direction.

The BD time t' is calculated by using the following formula:

$$t' = 2(X1 + X3)/(\text{the scanning speed})$$

X1=(the BD time t)×(the scanning speed)×(the changing rate of the rotating speed of the polygon motor 62)

X3=(the scanning time per line)×(the scanning speed)×(the changing rate of the rotating speed of the polygon motor 62)

The obtained BD time t' (the writing starting position in the main scanning direction) is stored in the NVRAM 43. During the subsequent printing operation, the scanning unit 19 begins writing each line of the image in the main scanning direction when the BD time t' has elapsed after the BD signal was outputted.

Since increasing the rotating speed of the polygon motor 62 also reduces the scanning cycle for each line, as illustrated in FIG. 7, the scanning interval on the photosensitive drums 28 in the sub-scanning direction is also reduced, reducing the size of the image formed on the paper 3 in the sub-scanning direction, as indicated by A2 (Y1) in FIG. 6. Similarly, decreasing the rotating speed of the polygon motor 62 expands the size of the formed image in the sub-scanning direction. Therefore, in S104 the CPU 40 sets the rotating speed of the belt motor 46 based on the magnification adjustment value. When increasing the rotating speed of the polygon motor 62 by 0.1 percent, for example, the CPU 40 also increases the rotating speed of the belt motor 46 by 0.1 percent. Increasing the rotating speed of the belt motor 46 in turn increases the speed at which the paper 3 is conveyed. Thus, the size of the formed image in the sub-scanning direction after adjusting the rotating speed of the polygon mirror in S102 becomes identical to the size of the formed image in the sub-scanning direction before adjusting, as indicated by A3 in FIG. 6.

Now, a frictional force exists between the belt 13 and the photosensitive drum 28, for example. If the belt 13 slips over the belt driver roller 12*b* due to the friction force, the driving force of the belt motor 46 cannot be transmitted to the belt 13 without loss. In the preferred embodiment, the rotating speed of the belt motor 46 relative to the rotating speed of the photosensitive drum 28 are set to a preset value such that above slipping does not occur. However, after changing the rotating speed of the belt motor 46 in S104, the relative speed is changed from the preset value. Therefore, in S105 the CPU 40 also changes the driving speed of the process motor 47 for driving the photosensitive drum 28 based on the magnification adjustment value. For example, when increasing the print magnification by 0.1 percent, for example, the CPU 40 increases the driving speeds of the process motor 47 by 0.1 percent, increasing the scanning interval on the photosensitive drum 28. Thus, the size of the formed image in the sub-scanning direction can be adjusted, while maintaining the relative speed. Further, the driving speed of the fixing motor 48, paper feed motor 49, and paper discharge motor 50 are also changed in a similar manner to adjust the rotating speeds of the feeding roller 5, registration rollers 6, belt 13, heating roller 31*a*, conveying roller 32, and discharge rollers 33, based on the print magnification adjustment value. Therefore, the printer 1 also can prevent relative changes in speed between each of these components and the paper 3 when the paper is outside of the image-forming unit 10. Consequently, the conveying state of the paper 3 does not change among these components, ensuring stable conveyance of the paper 3.

The CPU 40 is set to begin writing the first line on the photosensitive drum 28 for each color a prescribed time after the registration sensor 7 detects the leading edge of the paper 3, based on the correction data obtained based on the previous measurement of positional offset. However, offset in the writing starting position in the sub-scanning direction is produced when the driving speed of the belt motor 46 is changed in S104 described above. For example, when the speed of the belt motor 46 is increased along with an increase in the rotating speed of the polygon motor 62, the image-forming region is shifted downstream (rearward), as indicated by A3 (Y2) in FIG. 6. Therefore, in S106 the CPU 40 adjusts the writing starting position (the writing starting timing) in the sub-scanning direction for each color based on the magnification adjustment value.

Specifically, the amount of offset in the writing starting timing in the sub-scanning direction for each color is dependent on the distance over the belt 13 from the detection position by the registration sensor 7 to the transfer position for each color and the circumferential distance along each photosensitive drum 28 from the irradiating position of the scanning unit 19 for each color to the transfer position, and increases for colors farther downstream. The CPU 40 calculates the amount of offset in the writing starting timing in the sub-scanning direction for each color based on the above distances and the rotating speeds of the belt motor 46 and the polygon motor 62, and modifies the writing starting timing in the sub-scanning direction for each color to compensate for this offset, and stores the modified writing starting timing in the NVRAM 43. In the subsequent printing operation, the CPU 40 corrects the writing starting position for each color in the sub-scanning direction based on these modified writing starting timings.

By performing the process described above, the printer 1 can align the image-forming region in the sub-scanning direction with the original region (A1), as indicated by A4 in FIG. 6, and adjust the size of the image-forming region in the main scanning direction so that the image is formed in the image-forming region (A4) adjusted by the magnification acquired in S101.

In S107 the CPU 40 determines whether the magnification adjustment value calculated in S101 exceeds a prescribed threshold. In other words, if the magnification adjustment value is relatively small, the precision of image formation can likely be maintained by performing the above-described various adjustments based on calculated offsets in image-forming positions. However, if the magnification adjustment value is relatively large, a discrepancy between the calculated offset and actual offset may increase since the various adjustment values are larger. Offset in the image-forming positions for each color can particularly affect image quality. Hence, when the magnification adjustment value exceeds the prescribed threshold (S107: YES), in S108 the CPU 40 measures the positional offset in order to correct deviations in the image-forming positions among colors.

To measure positional offset, the CPU 40 controls the image-forming unit 10 to form the pattern P1 shown in FIG. 8, for example, on the belt 13. At this time, the CPU 40 drives the polygon motor 62, belt motor 46, and process motor 47 at the speeds set in S102, S104, and S105 above. The pattern P1 is also formed using the writing positions in the main and sub-scanning directions that were adjusted in S103 and S106.

As shown in FIG. 8, the pattern P1 has a first pattern 70 and a second pattern 71. The first pattern 70 includes a plurality of sets of four marks 70*k*, 70*y*, 70*m*, and 70*c* arranged at intervals in the sub-scanning direction. The marks 70*k*-70*c* are formed in the four colors as lines extending in the main scanning direction. The second pattern 71 includes a plurality of sets of four marks 71*k*, 71*y*, 71*m*, and 71*c* arranged at intervals in the sub-scanning direction. The marks 71*k*-71*c* are formed in the four colors as lines slanted at a prescribed angle θ to the main scanning direction. The pattern P1 is formed in a column near the both side edges of the belt 13.

The sensors 15 measure the positions of the marks 70*k*-70*c* in the first pattern 70, and the CPU 40 finds positional deviations in the sub-scanning direction for marks of non-black colors relative to the black marks based on the measurement results. Similarly, the sensors 15 measure the marks 71*k*-71*c* in the second pattern 71, and the CPU 40 finds positional deviations in the main scanning direction for marks of non-black colors relative to the black marks based on the measurement results and the positional deviations for colors relative to the sub-scanning direction found earlier. In S109 the CPU 40 finds (acquires) correction data for correcting offset in image-forming positions among the colors with respect to both the main and sub-scanning directions based on the above results and stores this correction data in the NVRAM 43. At this time, the writing starting timings (the writing starting positions) in the main scanning direction and the writing starting timings in the sub-scanning direction stored in the NVRAM 43 in S103 and S106 are cleared from the NVRAM 43. When printing images on the paper 3, the CPU 40 corrects offset in the image-forming position of each color relative to both the main and sub-scanning directions based on this correction data. Through this process, the printer 1 can reduce offset in image-forming positions among colors during the printing operation.

<Effects of the Embodiment>

When the rotating speed of the polygon mirror 61 is increased by adjusting the image-forming range in the main scanning direction, the scanning cycle of the scanning unit 19 is shortened, reducing the virtual scanning interval on the paper 3 in the sub-scanning direction. However, since the printer 1 of the preferred embodiment also increases the conveyed speed of the paper by increasing the rotating speed of the belt motor 46 in response to an increase in the rotating speed of the polygon mirror 61, the printer 1 can prevent the virtual scanning interval on the paper 3 from changing. As the result, the printer 1 can avoid a decline in image quality (offset in image-forming positions and irregular densities, for example) caused by modifying the speed of the polygon mirror 61.

The printer 1 of the preferred embodiment also increases the rotating speed of the photosensitive drum 28 in response to an increase in the rotating speed of the polygon mirror 61 to prevent a large change in the speed of the paper 3 relative to the photosensitive drums 28 caused by changing the rotating speed of the belt motor 46 in response to a change in the rotating speed of the polygon mirror 61. Accordingly, the paper 3 can be conveyed at a stable rate.

The printer 1 of the preferred embodiment also adjusts the writing starting positions in the sub-scanning direction based on the rotating speed of the polygon mirror 61. By doing so, the printer 1 can prevent the position of the formed image from being offset in the sub-scanning direction due to a change in the rotating speed of the polygon mirror 61.

The printer 1 of the preferred embodiment also adjusts the writing starting position in the main scanning direction based on the rotating speed of the polygon mirror 61. By doing so, the printer 1 can prevent the position of the formed image from being offset in the main scanning direction due to a change in the rotating speed of the polygon mirror 61.

When the rotating speed of the polygon mirror 61 is greatly modified, it is highly likely that the image-forming positions of each color are greatly offset in the sub-scanning direction. The printer 1 of the preferred embodiment measures positional offset when the magnitude of change in the rotating speed of the polygon mirror 61 based on the previous positional offset measurement exceeds a threshold value. Hence, even when the change in the rotating speed of the polygon mirror 61 is great, the printer 1 can suppress offset in the sub-scanning direction among the image-forming positions of the colors by reacquiring correction data. In this way, the printer 1 can avoid a decline in image quality caused by modifying the speed of the polygon mirror 61.

On the other hand, when the rotating speed of the polygon mirror 61 is changed very little, the offset among image-forming positions of the colors in the sub-scanning direction is relatively small. The printer 1 of the preferred embodiment performs further correction by adjusting the correction data based on the amount of change in the rotating speed when the amount of change made to the rotating speed is relatively small. Thus, the printer 1 can maintain a degree of image quality simply by performing an additional adjustment to the correction data based on the amount of speed modification, without re-measuring positional offset. In this way, the printer 1 can eliminate the wait time for the user caused by re-measuring positional offset and can reduce the amount of toner consumption.

When measuring positional offset, the printer 1 forms patterns with the rotating speed of the polygon mirror 61 set to the modified speed. Measuring positional offset after modifying the rotating speed of the polygon mirror 61 increases the reliability of the acquired correction data.

The printer 1 of the preferred embodiment also increases the conveying speed of the paper 3 by increasing the rotating speeds of the feeding roller 5, registration rollers 6, heating roller 31*a*, conveying roller 32, and discharge rollers 33 in response to an increase in the rotating speed of the polygon mirror 61 when the paper 3 is outside of the image-forming unit 10. In this way, the printer 1 prevents a difference in the conveying speed of the paper 3 when the paper 3 is passing through the image-forming unit 10 and the conveying speed of the paper 3 outside of the image-forming unit 10 when the rotating speed of the polygon mirror 61 is modified, thereby achieving smooth conveyance of the paper 3.

<Variations of the Embodiment>

While the invention has been described in detail with reference to specific embodiments thereof, it would be apparent to those skilled in the art that many modifications and variations may be made therein without departing from the spirit of the invention, the scope of which is defined by the attached claims.

(1) When acquiring the image-forming range in the main scanning direction after adjustment, the printer 1 may allow the user to directly measure the size of the printed image and specify the image-forming range. Alternatively, an original scanning unit may be employed to scan the image on the printed sheet to measure the size of the image, and the printer 1 may determine the post-adjusted image-forming range in the main scanning direction based on these results. Sensors may also be provided to measure the patterns formed on the belt or the like, and the printer 1 may determine the post-adjusted image-forming range in the main scanning direction based on the results of these measurements.

(2) The present invention can also be applied to an image-forming device having a duplex printing function. After printing the front side of a sheet, the printer 1 can print the back side after adjusting the image-forming region (print magnification) to account for contraction of the sheet caused by thermal fixing. In this case, the printer 1 can also modify the driving speed for the belt, photosensitive drums, and the like based on the speed of the polygon mirror to adjust the writing position in both the main and sub-scanning directions. While the printer 1 according to the preferred embodiment described above adjusts only the image-forming range in the main scanning direction, the printer 1 may also adjust the image-forming region in the sub-scanning direction to match the amount of adjustment of the image-forming region in the main scanning region (print magnification adjustment value) when performing duplex printing. The adjustment value for the image-forming region may be set based on a contraction ratio for the paper found based on data inputted by the user related to the paper (such as the weight of the paper and whether the front and back surfaces are coated, for example).

(3) While the printer 1 according to the preferred embodiment measures the amount of positional offset in both the main scanning direction and the sub-scanning direction in the main scan magnification adjustment process, the present invention may be applied to a method for measuring only positional offset in one of these directions or to a method of measuring density in order to calibrate density irregularities by forming density patterns on the belt or the like and measuring the densities of these patterns. These measurements of positional offset or densities may be performed as appropriate, irrespective of the main scan magnification adjustment process.

(4) In the preferred embodiment described above, the present invention is applied to a direct transfer tandem type color laser printer. However, the present invention may be applied to another type of image-forming device, such as an intermediate transfer type printer or a four-cycle printer. Further, the present invention is not limited to a color image-forming device, but may also be applied to a monochromatic image-forming device. Further, while the printer 1 of the preferred embodiment controls the conveyed speed of a sheet of paper serving as the target of image transfer, the present invention may be applied to a method for controlling the moving speed of another member targeted for image transfer based on the rotating speed of the polygon mirror, such as an intermediate transfer belt. The present invention may also be applied to a color image-forming device having a plurality of rotating mirrors corresponding to the plurality of colors.

(5) In the preferred embodiment, the rotating speed of the photosensitive drum 28 is adjusted in S105. However, it is possible to increase the size of the formed image in the sub-scanning direction by only increasing the rotating speed of the belt motor 46 is adjusted in S104, even if the process in S105 may be omitted process motor 47. Further, in the preferred embodiment, in S107 the CPU 40 determines whether the magnification adjustment value calculated in S101 exceeds a prescribed threshold. However, the process S107 may be performed immediate after performing the process S101.

What is claimed is:

1. An image-forming device comprising:

an image-forming unit comprising:

a rotatable mirror;

a light-emitting unit configured to repeatedly emit a laser beam toward the rotatable mirror, each laser beam being emitted over a predetermined period and reflected by the rotatable mirror;

a photosensitive drum configured to rotate at a predetermined rotating speed to be subject to a scanning with each reflected laser beam, the scanning forming an electrostatic latent image composed of a plurality of line electrostatic latent images extending in a main scanning direction over a first length, wherein neighboring line electrostatic latent images are spaced apart by a second length;

a developing unit configured to develop the electrostatic latent image with a developer to form a developer image; and a transferring unit configured to transfer the developer image formed on the photosensitive drum to a recording medium at a transferring position to form an image, the transferring unit overlapping a plurality of developer images on the recording medium to form the image, the plurality of developer images being developed with a plurality of developers different from one another;

a first conveying unit configured to convey the recording medium to the transferring position in a sub-scanning direction orthogonal to the main scanning direction;

a first changing unit configured to change a rotating speed of the rotatable mirror to change the first length;

a second changing unit configured to proportionally change a conveying speed of the first conveying unit in accordance with the change of the rotating speed of the rotatable mirror; and a third changing unit configured to proportionally change a rotating speed of the photosensitive drum in accordance with the change of the rotating speed of the rotatable mirror, wherein the image-forming unit is configured to form a plurality of test patterns when a changing rate of the rotating speed of the rotatable mirror exceeds a predetermined value;

an adjusting unit configured to adjust, in accordance with the change of the rotating speed of the rotatable mirror, a timing when the light-emitting unit emits the laser beam to adjust a position of the image in the sub-scanning direction, and a position of the image in the main scanning direction, a detecting unit configured to detect offsets of the plurality of test patterns from a predetermined position in the sub-scanning direction; and a producing unit configured to produce correction data based on the offsets, wherein the image-forming unit is configured to form the image based on the correction data.

2. The image-forming device according to claim 1, further comprising a modifying unit that modifies the correction data when the changing rate is smaller than the predetermined value.

3. The image-forming device according to claim 1, wherein the image-forming unit forms the plurality of patterns using the rotatable mirror whose rotating speed has been changed.

4. The image-forming device according to claim 1, further comprising:

a second conveying unit that conveys the recording medium outside the transferring position; wherein the third changing unit is configured to proportionally change a conveying speed of the second conveying unit in accordance with the change of the rotating speed of the rotatable mirror.

* * * * *